US009481026B2

(12) United States Patent
Ciocirlan et al.

(10) Patent No.: US 9,481,026 B2
(45) Date of Patent: Nov. 1, 2016

(54) PRESS DEVICE WITH ADJUSTMENT MECHANISM

(71) Applicant: Tyco Electronics Corporation, Berwyn, PA (US)

(72) Inventors: Bogdan Octav Ciocirlan, Hummelstown, PA (US); Craig M. Campbell, Mechanicsburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 93 days.

(21) Appl. No.: 14/524,042

(22) Filed: Oct. 27, 2014

(65) Prior Publication Data

US 2016/0114381 A1 Apr. 28, 2016

(51) Int. Cl.

| | |
|---|---|
| ***B21D 37/00*** | (2006.01) |
| ***B21J 13/08*** | (2006.01) |
| ***B21J 13/03*** | (2006.01) |
| ***H01R 43/04*** | (2006.01) |
| ***H01R 43/058*** | (2006.01) |
| ***H01R 43/048*** | (2006.01) |
| ***B21D 37/02*** | (2006.01) |
| ***B21D 5/01*** | (2006.01) |
| ***B21D 53/36*** | (2006.01) |
| ***B30B 1/18*** | (2006.01) |

(52) U.S. Cl.

CPC ..... *B21J 13/085* (2013.01); *B21D 5/01* (2013.01); *B21D 37/02* (2013.01); *B21D 53/36* (2013.01); *B21J 13/03* (2013.01); *B30B 1/18* (2013.01); *H01R 43/04* (2013.01); *H01R 43/0488* (2013.01); *H01R 43/058* (2013.01)

(58) Field of Classification Search

CPC H01R 43/0488; H01R 43/04; H01R 43/058; B21D 37/02; B21D 5/01; B21D 53/866; B21J 13/085; B21J 13/03; B30B 1/18

USPC ..... 72/413

See application file for complete search history.

(56) References Cited

U.S. PATENT DOCUMENTS

| | | | | | |
|---|---|---|---|---|---|
| 285,235 | A * | 9/1883 | Creagan | B21D 37/02 | 72/413 |
| 483,094 | A * | 9/1892 | Ansted | B21D 53/886 | 72/397 |
| 3,091,276 | A * | 5/1963 | Aquillon | H01R 43/04 | 29/753 |
| 4,019,362 | A * | 4/1977 | McKeever | H01R 43/04 | 226/167 |
| 4,212,188 | A * | 7/1980 | Pinson | B21D 5/01 | 72/413 |
| 5,187,969 | A * | 2/1993 | Morita | B21D 53/886 | 29/896.91 |
| 5,546,784 | A * | 8/1996 | Haas | B21D 37/02 | 72/413 |
| 5,937,510 | A * | 8/1999 | Seiersen | H01R 43/0488 | 29/751 |
| 5,954,175 | A * | 9/1999 | Haas | B21D 37/02 | 192/48.2 |
| 6,035,691 | A * | 3/2000 | Lin | A61B 17/8863 | 72/212 |
| 6,089,061 | A * | 7/2000 | Haas | B21D 37/02 | 72/14.8 |
| 6,301,777 | B1 * | 10/2001 | Sigler | H01R 43/058 | 29/566.2 |
| 7,254,981 | B2 * | 8/2007 | Ishizuka | H01R 43/0488 | 72/413 |

* cited by examiner

*Primary Examiner* — David B Jones

(57) ABSTRACT

A press device for forming a work piece includes a punch and an adjustment mechanism. The punch is configured to move along a punch stroke toward a work piece located in a punch zone below the punch. The punch is configured to engage the work piece during the punch stroke to form the work piece. The adjustment mechanism is coupled to the punch. The adjustment mechanism includes an actuator and a transfer member. The actuator is rotationally coupled to the transfer member. The transfer member is operably coupled to the punch. The actuator is configured to rotate. The transfer member converts the rotational movement of the actuator into translational movement that advances the punch linearly from a first operative position relative to the punch zone to a second operative position relative to the punch zone to adjust a bottom location of the punch along the punch stroke.

20 Claims, 4 Drawing Sheets

PRESS DEVICE WITH ADJUSTMENT MECHANISM

BACKGROUND OF THE INVENTION

The subject matter herein relates generally to press devices configured to form work pieces.

Work pieces, such as electrical terminals, are prevalent in electrical devices and applications. The electrical terminals are coupled to a conductive wire or cable, such as by a crimping process, to form electrical leads used to provide an electrical signal path between two electrical components in the same or different electrical devices. Some known electrical terminals are produced by stamping and forming sheet metal in a series of production steps using one or more mechanical presses. For example, a flat blank of sheet metal may be cut into a specific flat shape and then formed by bending the cut shape into a curved or at least non-flat geometry. Some known female terminals are formed to define a cavity that receives a blade of a corresponding male terminal therein. The formed female terminals must meet strict standards to ensure that, for example, the cavity is large enough to receive the blade, while also small enough that the female terminal engages the blade and applies a force on the blade to retain the blade in the cavity without damaging the blade. Due to terminals having varying thicknesses and widths, the mechanical presses that form the terminals often require fine adjustments in order to produce terminals that meet the exacting standards.

In some known presses, a die includes a punch that is held in a punch holder and a base. The punch and the punch holder move relative to the base to form terminals located on the base. In order to adjust parameters such as a height of the punch relative to the base, which affects an amount of bend applied to the terminals, some known presses require an operator to disassemble the die. For example, the operator may need to remove the die from the press, remove the punch from the punch holder, add shims to or remove shims from the top of the punch, reassemble the die, and then re-insert the die into the press. In addition to investing a considerable amount of time and effort in the adjustment, there is no way to immediately verify whether the adjustment is successful until the press is operational again. Thus, the operator may need to re-adjust the press multiple times in a trial and error fashion until the parameters are correct, each time requiring another disassembly and reassembly process. A need remains for easy and efficient in-press adjustment of the punch in the press that allows for accurate fine tuning of the punch.

BRIEF DESCRIPTION OF THE INVENTION

In an embodiment, a press device for forming a work piece is provided that includes a punch and an adjustment mechanism. The punch is configured to move along a punch stroke toward a work piece located in a punch zone below the punch. The punch is configured to engage the work piece during the punch stroke to form the work piece. The adjustment mechanism is coupled to the punch. The adjustment mechanism includes an actuator and a transfer member. The actuator is rotationally coupled to the transfer member. The transfer member is operably coupled to the punch. The actuator is configured to rotate. The transfer member converts the rotational movement of the actuator into translational movement that advances the punch linearly from a first operative position relative to the punch zone to a second operative position relative to the punch zone to adjust a bottom location of the punch along the punch stroke.

In another embodiment, a press device for forming a work piece is provided that includes a punch and an adjustment mechanism. The punch is configured to move along a punch stroke toward a work piece located in a punch zone below the punch. The punch is configured to engage the work piece during the punch stroke to form the work piece. The adjustment mechanism is coupled to the punch. The adjustment mechanism includes a knob and a threaded drive bolt. The drive bolt is rotationally coupled to the knob such that rotation of the knob causes the drive bolt to rotate. The drive bolt is threadably coupled to the punch through an opening in a top wall of the punch. Rotation of the drive bolt via the knob moves the punch linearly from a first operative position relative to the punch zone to a second operative position relative to the punch zone to adjust a bottom location of the punch along the punch stroke.

In another embodiment, a press device for forming a work piece is provided that includes a left punch member, a right punch member, a left adjustment mechanism, and a right adjustment mechanism. The left punch member is disposed adjacent to the right punch member. The left and right punch members are configured to move together along a punch stroke toward a work piece located in a punch zone below the left and right punch members. The left and right punch members are configured to engage respective left and right wings of the work piece during the punch stroke to bend the left and right wings. The left and right adjustment mechanisms are coupled to the left and right punch members, respectively. The left and right adjustment mechanisms each include a knob and a threaded drive bolt. The drive bolt is rotationally coupled to the knob such that rotation of the knob causes the drive bolt to rotate. The drive bolt is threadably coupled to the respective punch member through an opening in a top wall of the punch member. Rotation of the drive bolt via the knob moves the respective punch member linearly from a first operative position relative to the punch zone to a second operative position relative to the punch zone to adjust a bottom location of the respective punch member along the punch stroke.

DETAILED DESCRIPTION OF THE INVENTION

Figure 1:
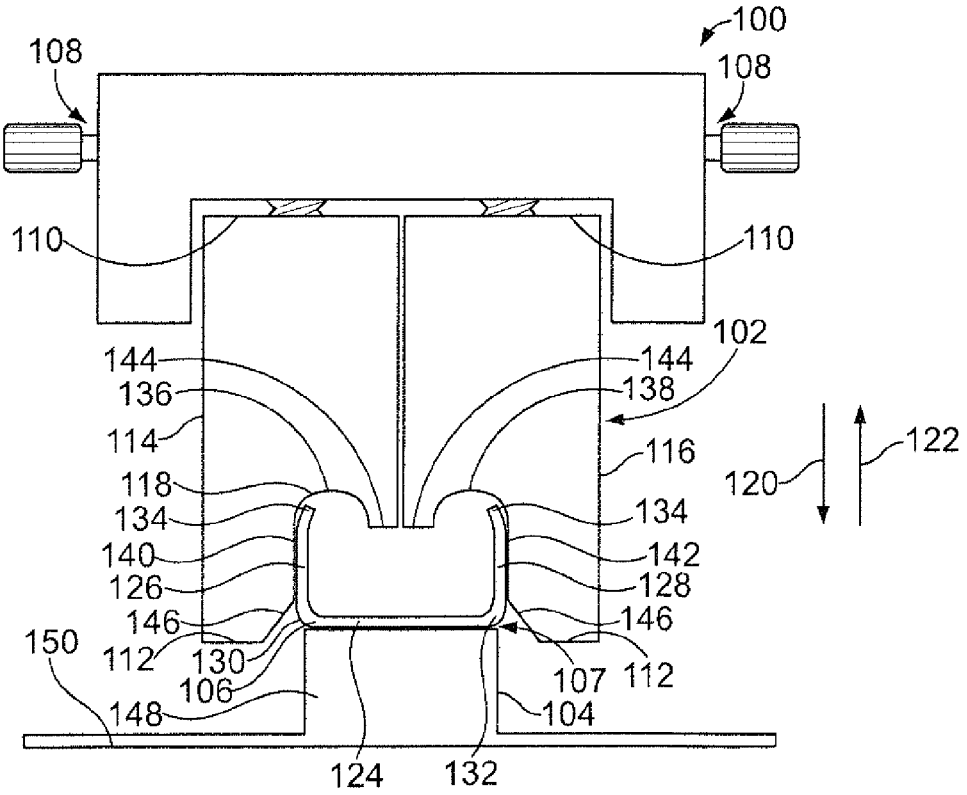
FIG. 1 is a front view of a press device in accordance with an exemplary embodiment.

FIG. 1 illustrates a press device 100 in accordance with an exemplary embodiment. The press device 100 is used to form a work piece. In an exemplary embodiment described herein, the work piece is an electrical terminal. However the press device may be used to form a variety of work pieces into a variety of different shapes, sizes, and/or configurations. The press device 100 includes a punch 102 and a base 104. In the exemplary embodiment, the punch 102 is movable, and the base 104 is stationary. The base 104 receives work pieces 106 thereon. The work pieces 106 are referred to herein as terminals 106. The terminals 106 may be at least partially formed or pre-formed prior to being received on the base 104. For example, the terminals 106 may be stamped from a planar panel into a designated profile, but the terminals 106 remain planar when received on the base 104. The base 104 defines a punch zone 107, and the terminals 106 are received in the punch zone 107 consecutively, one at a time. The punch 102 moves relative to the base 104 to engage each terminal 106 in the punch zone 107. The punch 102 bends or forms each terminal 106 into a pre-defined formed shape that may no longer be planar.

The formed shape may have a mating end and a termination end. The termination end may then be crimped or otherwise connected to a wire, for example, to form an electrical lead. The mating end of the terminal 106 may define a mating interface configured to electrically connect to a mating contact. The amount of bending applied to the terminal 106 by the punch 102 affects the dimensions of the mating interface. For example, greater bending of the terminal 106 by the punch 102 may result in the mating interface having a smaller area than a mating interface with less bending of the terminal 106. In an exemplary embodiment, the press device 100 further includes an adjustment mechanism 108 that is configured to adjust the position of the punch 102 relative to the base 104 to control an amount of bending of the terminal 106. By making fine adjustments using the adjustment mechanism 108, the terminals 106 on the base 104 may be bent to pre-defined shapes having dimensions that meet strict specifications for acceptable terminals.

The punch 102 of the press device 100 may additionally or alternatively be used to produce electrical leads by crimping the termination end of the terminal 106 around an end of a wire (not shown) in the punch zone 107. The adjustment mechanism 108 is configured to adjust the position of the punch 102 relative to the punch zone 107 on the base 104 to control an amount of bending (for example, direction and extent of bending) of the terminal 106 around the end of the wire during the crimping operation. For example, if the terminal 106 is not bent sufficiently, the wire may be susceptible to being pulled out from the terminal 106, and if the terminal 106 is bent too much, the terminal 106 may damage the wire. Thus, the press device 100 described herein that includes the punch 102 and the adjustment mechanism 108 may be used for forming the mating end of the work piece 106 (for example, terminal) and/or for crimping the termination end of the work piece 106 to a wire to produce a lead.

The punch 102 has a top wall 110 and a bottom wall 112 opposite the top wall 110. The punch 102 also has a left wall 114 and an opposite right wall 116. The left and right walls 114, 116 extend between the top and bottom walls 110, 112. As used herein, relative or spatial terms such as "top," "bottom," "front," "rear," "left," and "right" are only used to distinguish the referenced elements and do not necessarily require particular positions or orientations in the press device 100 or in the surrounding environment of the press device 100. The punch 102 defines a roll profile 118 in the bottom wall 112. The roll profile 118 extends towards the top wall 110. The roll profile 118 is configured to engage the terminal 106 on the base 104.

Figure 2:
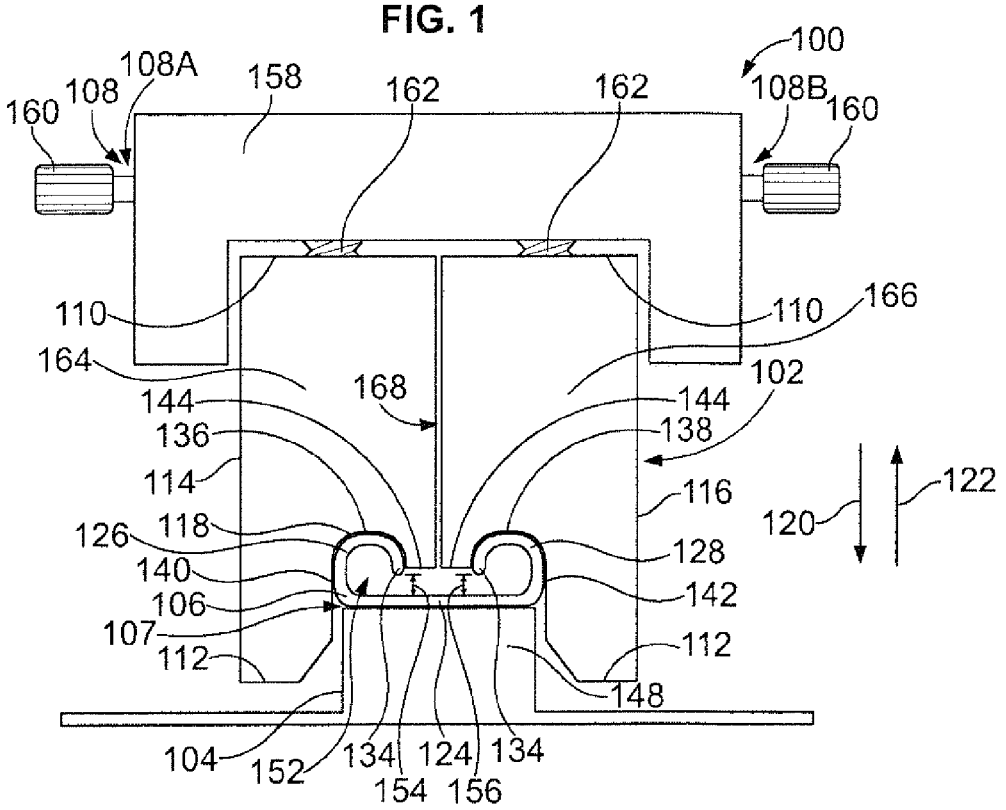
FIG. 2 is a front view of the press device with a punch in a punch stroke ending position.

In FIG. 1, the punch 102 is in a released position relative to the terminal 106 on the base 104. FIG. 2 is a front view of the press device 100 with the punch 102 in a forming position relative to the terminal 106. The press device 100 may be at least part of a mechanical press. During operation, the punch 102 is actuated or driven through a punch stroke by an actuator (not shown) of the press. Optionally, the actuator may be a ram (not shown) powered by a motor having a crank shaft that moves the ram. In the released position shown in FIG. 1, the punch 102 is disposed above the terminal 106 and does not engage the terminal 106. In the forming position shown in FIG. 2, the punch 102 engages the terminal 106. The punch 102 is cyclically driven through the punch stroke from a released position at a top of the punch stroke to a forming position at a bottom of the punch stroke, then returning to the released position at the top. The punch 102 in the released position shown in FIG. 1 may or may not be located at the top of the punch stroke. The punch 102 in the forming position shown in FIG. 2 may or may not be located at the bottom of the punch stroke. The punch stroke has both an advancing or downward direction 120 and a return or upward direction 122.

During operation, the punch 102 is advanced in the downward direction 120 toward the base 104 to an initial contact position, in which the punch 102 initially contacts the terminal 106. The punch 102 continues moving downward to the bottom position. As the punch 102 is advanced from the initial contact position to the bottom position, the punch 102 transitions through a forming stage of the punch stroke. During the forming stage, the terminal 106 is bent or curled by the roll profile 118 of the punch 102, as shown in FIG. 2. The terminal 106 is sandwiched between the base 104 below and the descending punch 102 above, and the terminal 106 conforms to the shape of the roll profile 118. The forming of the terminal 106 thus occurs during the downward component of the punch stroke. The punch 102 then retreats in the upward direction 122 to the released position at the top of the punch stroke. The punch 102 separates or releases from the formed terminal 106 as the punch 102 moves upward away from the base 104 and the terminal 106. After forming, the terminal 106 may be moved out of the punch zone 107 to a different location for storage or for additional processing, such as crimping to a wire. Another terminal 106 may be advanced into the punch zone 107, and the punch 102 may begin another punch stroke by moving in the downward direction 120 to engage and form the new terminal 106.

In the illustrated embodiment shown in FIG. 1, the terminal 106 in the punch zone 107 includes a foundation 124, a left wing 126, and a right wing 128. The left wing 126 extends from a left edge 130 of the foundation 124, and the right wing 128 extends from an opposite right edge 132 of the foundation 124. The left and right wings 126, 128 may be integral to the foundation 124 and formed by creasing a blank strip of sheet metal and bending the wings 126, 128 upward from the foundation 124. The wings 126, 128 may be linear or at least generally linear over a portion of the length of the wings 126, 128. For example, the wings 126, 128 may each have a curved distal end 134, and the wings 126, 128 are linear between the foundation 124 and the distal ends 134. The wings 126, 128 optionally may extend perpendicularly from the foundation 124 of the terminal 106.

The roll profile 118 of the punch 102 includes at least one curved section, referred to herein as an arch. In an embodiment, the roll profile 118 includes a left arch 136 and a right arch 138. The left and right arches 136, 138 have concave shapes relative to the bottom wall 112. The left and right arches 136, 138 are separated from each other by a middle region 144 of the roll profile 118. The left arch 136 is connected to and extends from a left stem 140. The right arch 138 is likewise connected to and extending from a right stem 142. The left and right stems 140, 142 extend generally toward the top wall 110 of the punch 102. The roll profile 118 may resemble an "M" shape. Optionally, the punch 102 may include beveled edges 146 between the bottom wall 112 and the stems 140, 142, respectively.

The base 104 includes a platform 148 that extends upwards from a floor 150. The terminal 106 is received on the platform 148. The platform 148 may have a width that is equal to or less than a width of the terminal 106. As shown in FIG. 1, as the punch 102 moves in the downward direction 120 during the punch stroke towards the base 104, the terminal 106 is received within the roll profile 118. For example, the left wing 126 of the terminal 106 is at least proximate to the left stem 140 of the roll profile 118, and the right wing 128 is at least proximate to the right stem 142. If the terminal 106 is misaligned relative to the punch 102, the beveled edges 146 and/or the stems 140, 142 may engage the corresponding wings 126, 128 to center the terminal 106 in the roll profile 118. As the punch 102 continues movement toward the bottom position, the distal ends 134 of the wings 126, 128 engage the respective left and right arches 136, 138 of the roll profile 118. Further downward movement of the punch 102 forces the distal ends 134 to curl within the respective arches 136, 138 towards the middle region 144.

Referring now to FIG. 2, the punch 102 is in the forming stage. The punch 102 may be in the bottom position of the punch stroke. The bottom wall 112 of the punch 102 extends beyond the terminal 106 and at least a portion of the platform 148 of the base 104. The terminal 106 in FIG. 2 is formed. The left and right wings 126, 128 are each curled towards each other across the middle region 144, such that the wings 126, 128 now have curved shapes. The distal ends 134 of the wings 126, 128 extend downward towards the foundation 124 of the terminal 106. The formed terminal 106 defines a mating interface that is configured to engage a mating contact. The terminal 106 defines a cavity 152 above the foundation 124, between the left and right wings 126, 128, and below the distal ends 134 of the wings 126, 128. The cavity 152 is configured to receive a blade contact (not shown). The distal ends 134 of the wings 126, 128 may engage a top surface of the blade contact and force a bottom surface of the blade contact into engagement with the foundation 124 of the terminal 106. Due to the curled shapes of the wings 126, 128, the distal ends 134 may be at least partially deflectable to apply a biasing force on the blade contact. The biasing force maintains electrical contact between the terminal 106 and the blade contact.

In an embodiment, various dimensions of the formed terminal 106 may need to be adjusted due to different shapes and/or sizes of mating contacts, to accommodate changes in the terminals 106 (for example, variations in thickness and/or width of the sheet metal blanks used to form the terminals 106), or the like, to provide proper contact between the terminal 106 and the mating contact. One such dimension is a cavity height, defined as the vertical height of the space between the foundation 124 and the distal end 134 of one of the wings 126, 128. For embodiments that include left and right inwardly-curling wings 126, 128, the terminal 106 includes both a left cavity height 154 (between the distal end 134 of the left wing 126 and the foundation 124) and a right cavity height 156 (between the distal end 134 of the right wing 128 and the foundation 124). To adjust the cavity heights 154, 156, the location of the bottom position of the punch 102 is modified relative to the base 104. For example, to increase the cavity heights 154, 156, the bottom position of the punch 102 is raised such that the punch 102 does not move as far in the downward direction 120 during the punch stroke. Conversely, to decrease the cavity heights 154, 156 of the terminals 106 in the punch zone 107, the bottom position of the punch 102 is lowered such that the punch 102 moves further in the downward direction 120 during the punch stroke.

In an embodiment, the punch 102 is coupled to a punch holder 158. The punch holder 158 is disposed above the top wall 110 of the punch 102. Optionally, the punch holder 158 may extend at least partially around the left and right walls 114, 116 of the punch 102. The punch holder 158 moves with the punch 102 along the punch stroke. For example, the ram or other actuator that drives the punch 102 optionally may engage the punch holder 158, and the punch holder 158 transfers the force from the actuator to the punch 102. The bottom position of the punch 102 along the punch stroke may be adjusted by adjusting the position of the punch 102 relative to the punch holder 158. For example, the punch 102 moves between an adjusted top position and an adjusted bottom position after adjustment of the punch 102, while the upper and lower positions of the punch holder 158 do not change. In some known press machines, in order to adjust the positions of the punch relative to the terminals, a user is required to disassemble the machine to remove the punch and punch holder. Then, the user uncouples the punch from the punch holder and adds or removes shims or spacers between the punch and punch holder to adjust the position of the punch relative to the punch holder. Once the punch and punch holder are re-assembled in the press machine, the operation may resume. But, due to a high degree of precision required in the adjustment to meet strict terminal specifications, the dis-assembly and re-assembly process may need to be repeated for multiple iterations of trial and error until the punch 102 is correctly adjusted. Thus, the adjustment process in these known press machines is complex, absorbs time and effort, and is not accurate.

In an exemplary embodiment, the press device 100 includes the adjustment mechanism 108 that provides in situ adjustment of the punch 102 without requiring any deconstruction of the press device 100. The adjustment mechanism 108 includes at least an actuator 160 and a transfer member 162. The adjustment mechanism 108 may be held by the punch holder 158. The transfer member 162 is operably coupled to the punch 102 either directly or indirectly. As used herein, two components are "operably coupled" when the components are linked together, connected, or joined, directly or indirectly. In the illustrated embodiment, the transfer member 162 of the adjustment mechanism 108 is a drive bolt that extends from the punch holder 158 and engages the punch 102 in order to couple the punch 102 and the punch holder 158. In addition, the actuator 160 is a knob in the illustrated embodiment. The actuator 160 is rotationally coupled to the transfer member 162, directly or indirectly, such that rotation of the actuator 160 causes the transfer member 162 to rotate. As used herein, two components are "rotationally coupled" when rotation of a first of the components causes the second component to rotate. The rotation of the second component need not be in the same direction, along the same axis of rotation, or for the same amount (for example, rotational distance) as the rotation of the first component. Also, the two components may be indirectly coupled to each other such that the first component does not engage the second component directly and there is at least one intermediary component therebetween.

As described further below, rotation of the actuator 160 causes the transfer member 162 to rotate. The transfer member 162 converts the rotational movement of the actuator 160 into translational movement that advances the punch 102 linearly relative to the punch holder 158 and relative to the punch zone 107. For example, a given amount of rotation of the actuator 160 causes the punch 102 to move linearly from a first operative position to a second operative position relative to the punch zone 107 to adjust an amount that the punch 102 bends the terminal 106 in the punch zone 107 during the punch stroke. The linear movement of the punch 102 caused by the adjustment mechanism 108 may adjust the top and bottom positions of the punch 102 along the punch stroke, but is otherwise independent of the movement of the punch 102 along the punch stroke. For example, the first operative position may be the bottom location of the punch 102 along the punch stroke prior to rotation of the actuator 160, and the second operative position may be the bottom location of the punch 102 after rotation of the actuator 160. The speed and total distance traversed of the punch 102 along the punch stroke do not change due to adjustments by the adjustment mechanism 108.

In an exemplary embodiment, the punch 102 includes a left punch member 164 and a right punch member 166. The left and right punch members 164, 166 are discrete components that together define the punch 102. The left punch member 164 is adjacent to the right punch member 166. The left and right punch members 164, 166 are separated from each other by a seam 168. The left and right punch members 164, 166 may each define half of the punch 102, although the punch members 164, 166 need not have equal dimensions. The left punch member 164 defines the left arch 136 and the left stem 140 of the roll profile 118. The right punch member 166 defines the right arch 138 and the right stem 142 of the roll profile 118. The punch 102 is divided into left and right punch members 164, 166 to allow the press device 100 to bend the left wing 126 of the terminals 106 independently of the bending of the right wing 128. For example, in an exemplary embodiment, the press device 100 includes a first adjustment mechanism 108A coupled to the left punch member 164 and a second adjustment mechanism 108B coupled to the right punch member 166. The first adjustment mechanism 108A is configured to adjust the position of the left punch member 164 relative to the punch zone 107 on the base 104. The second adjustment mechanism 108B is configured to adjust the position of the right punch member 166 relative to the punch zone 107 independently of the position or adjustment of the left punch member 164. As such, the left and right punch members 164, 166 may be moved relative to each other by actuating the first and/or second adjustment mechanism 108A, 108B.

Figure 3:
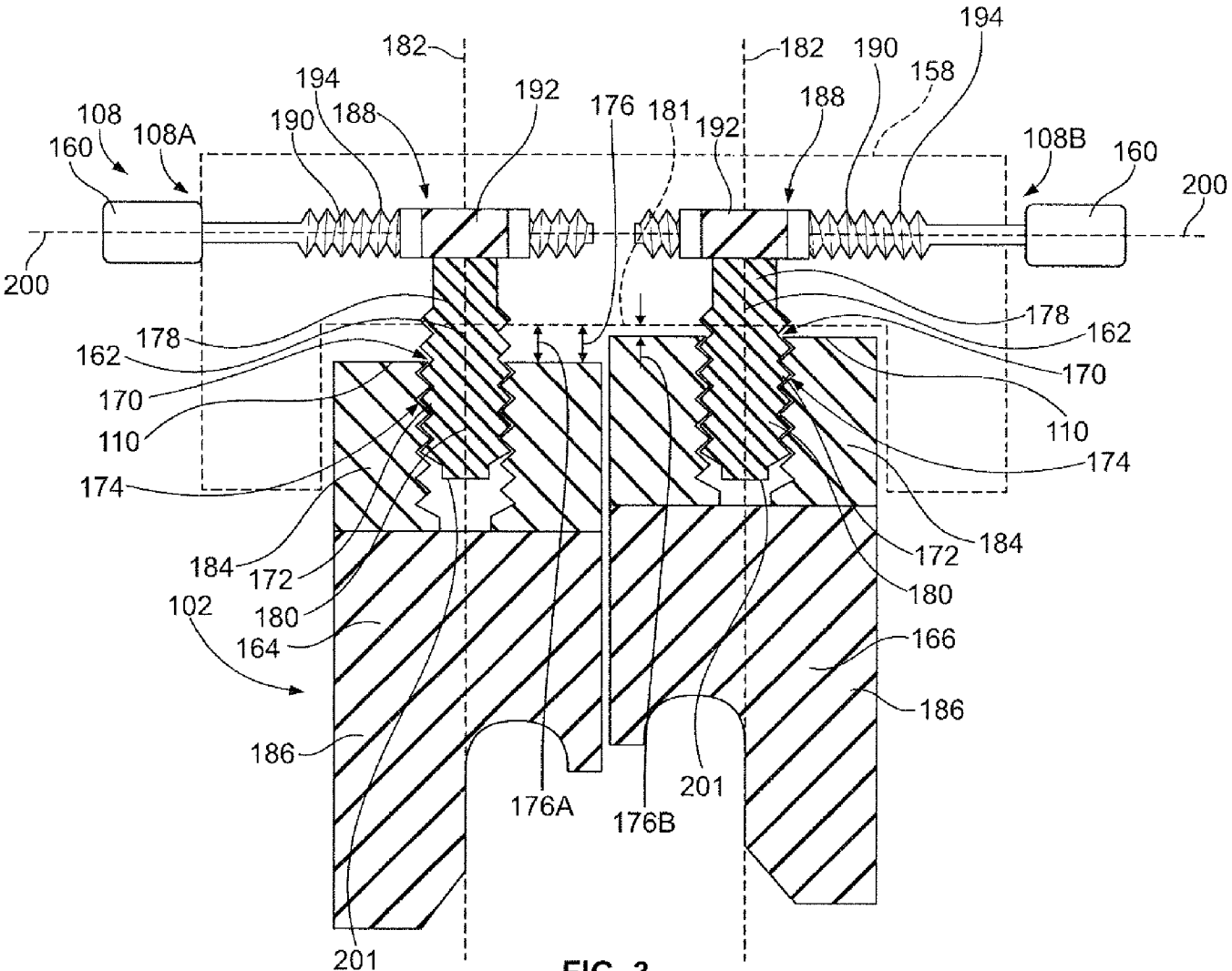
FIG. 3 is a cross-sectional front view of the punch and an adjustment mechanism of the press device according to an embodiment.

FIG. 3 is a cross-sectional front view of the punch 102 and the adjustment mechanism 108 of the press device 100 (shown in FIGS. 1 and 2) according to an embodiment. The cross-section shown in FIG. 3 extends through the punch 102 and the transfer member 162 of the adjustment mechanism 108, although not through the actuator 160 of the adjustment mechanism 108, which is at a depth behind the plane of the cross-section. The punch holder 158 is shown in phantom in FIG. 3. The punch 102 includes the left and right punch members 164, 166. The adjustment mechanism 108 includes the first adjustment mechanism 108A that is coupled to the left punch member 164 and the second adjustment mechanism 108B that is coupled to the right punch member 166. The first and second adjustment mechanisms 108A, 108B may have similar components and constructions. The following description of the adjustment mechanism 108 generally applies to each of the adjustment mechanisms 108A, 108B except when noted. In an alternative embodiment, the punch 102 is a unitary body that is coupled to a single adjustment mechanism 108.

In the illustrated embodiment, the actuator 160 is a knob, and the transfer member 162 is a threaded drive bolt. As used herein, the actuator 160 may be referred to as knob 160, and the transfer member 162 may be referred to as drive bolt 162. In an alternative embodiment shown in FIG. 6 and described below with reference to FIG. 6, the actuator 160 is a round gear, and the transfer member 162 is an eccentric bushing. In other embodiments, the actuator 160 may be a crank, a shaft, a wheel, or the like, and the transfer member 162 may be a pawl, connecting rods, a rack gear, or the like.

The drive bolt 162 of each adjustment mechanism 108A, 108B is threadably coupled to the respective punch member 164, 166 through an opening 170 at the top wall 110 of the punch member 164, 166. For example, the drive bolt 162 has helical threads 172, and the opening 170 defines corresponding helical grooves 174 that receive and engage the threads 172. Thus, as used herein, "threadably coupled" refers to the mechanical connection of two components via engagement of helical threads. An upper segment 178 of the drive bolt 162 is held by the punch holder 158. A lower segment 180 of the drive bolt 162 extends from a ceiling 181 of the punch holder 158 across an adjustment spacing 176 and into the opening 170. In the illustrated embodiment, the top wall 110 of each of the punch members 164, 166 is defined by a respective nut 184. The nut 184 includes the opening 170 and the helical grooves 174 that receive and engage the threads 172 of the drive bolt 162. The opening 170 may extend fully through the nut 184. The nut 184 is fixed to a body 186 of the respective punch member 164, 166. Alternatively, the opening 170 and helical grooves 174 of each of the punch members 164, 166 may be defined by the body 186 of the punch members 164, 166, such as by forming the body 186 to include the opening 170 and grooves 174 or by machining the opening 170 and grooves 174 into the preformed body 186.

The drive bolt 162 rotates along a drive bolt axis 182. As the drive bolt 162 rotates, the respective punch member 164, 166 does not rotate. Rather, rotation of the drive bolt 162 causes the respective punch member 164, 166 to move linearly relative to the drive bolt 162 in a direction parallel to the drive bolt axis 182. The punch holder 158 holds the drive bolt 162 such that the drive bolt 162 is permitted to rotate but not translate relative to the punch holder 158. For example, the drive bolt 162 may be held within a bearing (not shown) attached to the punch holder 158. Thus, the punch holder 158 restricts translational movement of the drive bolt 162. As the drive bolt 162 rotates, the helical threads 172 of the drive bolt 162 convert the rotational movement into translational movement, causing the punch member 164, 166 to translate (or change location) relative to the punch holder 158. For example, rotation of the drive bolt 162 in one rotational direction, such as clockwise, pulls the respective punch member 164, 166 towards the punch holder 158 such that the adjustment spacing 176 between the punch member 164, 166 and the ceiling 181 of the punch holder 158 decreases. Conversely, rotation of the drive bolt 162 in the other rotational direction, such as counter-clockwise, pushes the punch member 164, 166 away from the punch holder 158, increasing the adjustment spacing 176 between the punch member 164, 166 and the ceiling 181 of the punch holder 158. Therefore, rotation of the drive bolt 162 causes the respective punch member 164, 166 to move from a first operative position to a second operative position relative to the punch holder 158 and relative to the punch zone 107 (shown in FIGS. 1 and 2). As shown in FIG. 3, the left punch member 164 is farther from the punch holder 158 than the right punch member 166 such that the adjustment spacing 176A between the ceiling 181 and the left punch member 164 is greater than the adjustment spacing 176B between the ceiling 181 and the right punch member 166. It is recognized that since the drive bolts 162 are each restricted from translating relative to the punch holder 158, distal ends 201 of the drive bolts 162 are equidistant from the ceiling 181, regardless of the relative positions of the punch members 164, 166.

In an exemplary embodiment, the drive bolt 162 is rotationally coupled to the knob 160 indirectly via a worm drive 188. The worm drive 188 includes a worm bolt 190 and a worm wheel 192. The worm bolt 190 is coupled to and rotationally fixed to the knob 160. As used herein, two components are "rotationally fixed" when rotation of one of the components causes the other component to rotate in the same direction and amount (for example, rotational distance) along the same axis of rotation. For example, rotation of the knob 160 clockwise 180° along a knob axis 200 causes the worm bolt 190 to rotate clockwise 180° along the knob axis 200. Components that are rotationally fixed are inherently rotationally coupled, but components that are rotationally coupled are not necessarily rotationally fixed. The worm wheel 192 is coupled to and rotationally fixed to the drive bolt 162. For example, the worm wheel 192 is coupled to the upper segment 178 of the drive bolt 162. The worm bolt 190 includes threads 194. The worm wheel 192 includes a plurality of teeth 196 (shown in FIG. 4) along an outer perimeter 198 (FIG. 4) of the worm wheel 192. The threads 194 of the worm bolt 190 intermesh with the teeth 196 of the worm wheel 192 such that rotation of the worm bolt 190 rotates the worm wheel 192, and vice-versa.

The worm drive 188 transmits rotation over two non-parallel axes. For example, the worm bolt 190 and the knob 160 rotate along the knob axis 200, while the worm wheel 192 and the drive bolt 162 rotate along the drive bolt axis 182. The drive bolt axis 182 extends at an oblique angle relative to the knob axis 200. In the illustrated embodiment, the drive bolt axis 182 is perpendicular to the knob axis 200. More specifically, rotation of the knob 160 along the knob axis 200 rotates the worm bolt 190 along the knob axis 200; rotation of the worm bolt 190 rotates the worm wheel 192 along the drive bolt axis 182; and rotation of the worm wheel 192 rotates the drive bolt 162 along the drive bolt axis 182. As described above, rotation of the drive bolt 162 moves the respective punch member 164, 166 linearly relative to the punch holder 158. Therefore, by rotating the knob 160 of one of the adjustment mechanisms 108A, 108B along the knob axis 200, the respective punch member 164, 166 moves linearly along the drive bolt axis 182 a direction and distance that corresponds to the rotational direction and amount of rotation, respectively, of the knob 160. The knobs 160 of the adjustment mechanisms 108A, 108B may be configured to be rotated manually by a user. Alternatively, or in addition, the rotation of the knobs 160 may be actuated and controlled automatically by a motor (not shown).

The knobs 160 of the first and second adjustment mechanisms 108A, 108B are configured to be rotated independently of each other to allow for independent adjustment of the positions of the left and right punch members 164, 166 relative to the punch zone 107 (shown in FIGS. 1 and 2). For example, referring back to FIG. 2, due to varying thicknesses of the terminal 106 or terminal specifications, the left punch member 164 may be adjusted to be closer to the punch zone 107 than the right punch member 166 such that the left arch 136 is closer to the punch zone 107 than the right arch 138. As a result, during the punch stroke, the left wing 126 of the terminal 106 is curled towards the foundation 124 of the terminal 106 by the left punch member 164 to a greater extent than the right wing 128 is curled to the foundation 124 by the right punch member 166.

Figure 4:
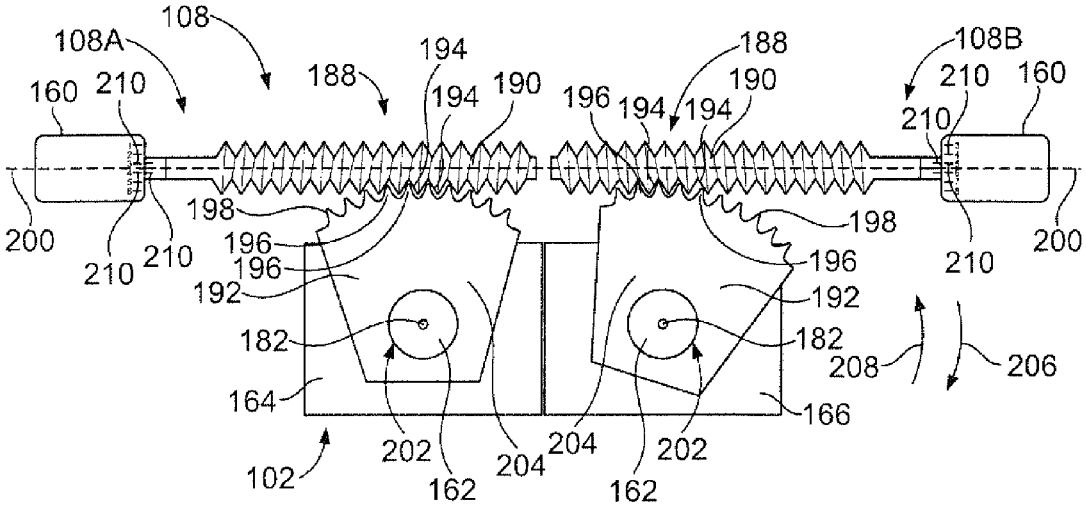
FIG. 4 is a top view of the adjustment mechanism and the punch according to an embodiment.

FIG. 4 is a top view of the adjustment mechanism 108 and the punch 102 according to an embodiment. As in the embodiment shown in FIGS. 1-3, the punch 102 includes the left punch member 164 and the right punch member 166, and the adjustment mechanism 108 includes the first adjustment mechanism 108A and the second adjustment mechanism 108B. In FIG. 4, the worm drives 188 of the first and second adjustment mechanisms 108A, 108B are shown in detail. The threads 194 of the worm bolt 190 engage the teeth 196 of the worm wheel 192. The teeth 196 are defined along the curved outer perimeter 198 of the worm wheel 192. The drive bolt 162 may couple to the worm wheel 192 through a central aperture 202 in the worm wheel 192. The drive bolt axis 182 extends through the central aperture 202, and is represented by a point in FIG. 4. The curved outer perimeter 198 may extend along an arc of a circle defined with the drive bolt axis 182 as the center. Alternatively, the worm wheel 192 is circular and the curved outer perimeter 198 extends the entire circumference of the circle defined with the drive bolt axis 182 as the center. The worm wheel 192 has a flat top surface 204. The flat top surface 204 of the worm wheel 192 is configured to absorb the impact of the actuator (not shown), such as a movable ram, to move the punch members 164, 166 and the punch holder 158 (shown in FIG. 3) in the advancing direction 120 (shown in FIG. 1) along the punch stroke. The force is exerted through the worm wheel 192 and along the drive bolt 162 to the respective punch member 164, 166. Very little, if any, force is exerted on the worm bolt 190 or the knob 160. Thus, movement of the punch members 164, 166 and the punch holder 158 along the punch stroke does not damage the worm bolt 190 or affect the rotational position of the knob 160.

In an embodiment, rotation of the knob 160 along the knob axis 200 causes the worm bolt 190 to rotate in the same direction. The knob 160 and the worm bolt 190 are restricted from translating relative to the punch holder 158 (shown in FIG. 3). As the worm bolt 190 rotates, the helical threads 194 of the worm bolt 190 engage corresponding teeth 196 of the worm wheel 192. The engagement between the threads 194 and the teeth 196 cause the worm wheel 192 to rotate clockwise 206 or counter-clockwise 208 around the drive bolt axis 182, depending on the direction of rotation of the worm bolt 190. As shown in FIG. 4, the worm wheel 192 of the second adjustment mechanism 108B is rotated clockwise 206 more than the worm wheel 192 of the first adjustment mechanism 108A. As described above, rotation of the worm wheel 192 rotates the drive bolt 162, which linearly moves the respective punch member 164, 166 relative to the punch holder 158.

The worm drive 188 may have a large reduction ratio between the worm bolt 190 and the worm wheel 192. For example, a full 360° rotation of the knob 160 may advance the worm wheel 192 only the length of one or a few teeth 196. Therefore, a first amount of rotation of the knob 160 results in a second amount of rotation of the drive bolt 162 that may be significantly less than the first amount of rotation. The large reduction ratio is useful for providing fine adjustments of the respective punch member 164, 166 relative to the punch zone 107 (shown in FIGS. 1 and 2). In addition, the large reduction ratio also functions as a mechanical brake to prohibit forces applied to the drive bolt 162 and/or worm wheel 192 from rotating the worm bolt 190 and the knob 160. Therefore, after setting the position of the respective punch member 164, 166 by rotating the knob 160, it is unlikely that forces absorbed during the punch stroke will cause the punch member 164, 166 to unintentionally migrate from the set position.

In an embodiment, the knob 160 of each of the first and second adjustment mechanisms 108A, 108B includes markings 210 used to quantify an amount of rotation of the knob 160. The knob 160 may be calibrated with the respective punch member 164, 166, such that the markings 210 indicate the relationship between rotational movement of the knob 160 and linear translational movement of the punch member 164, 166. For example, the knob 160 may be a micrometer head.

Figure 5:
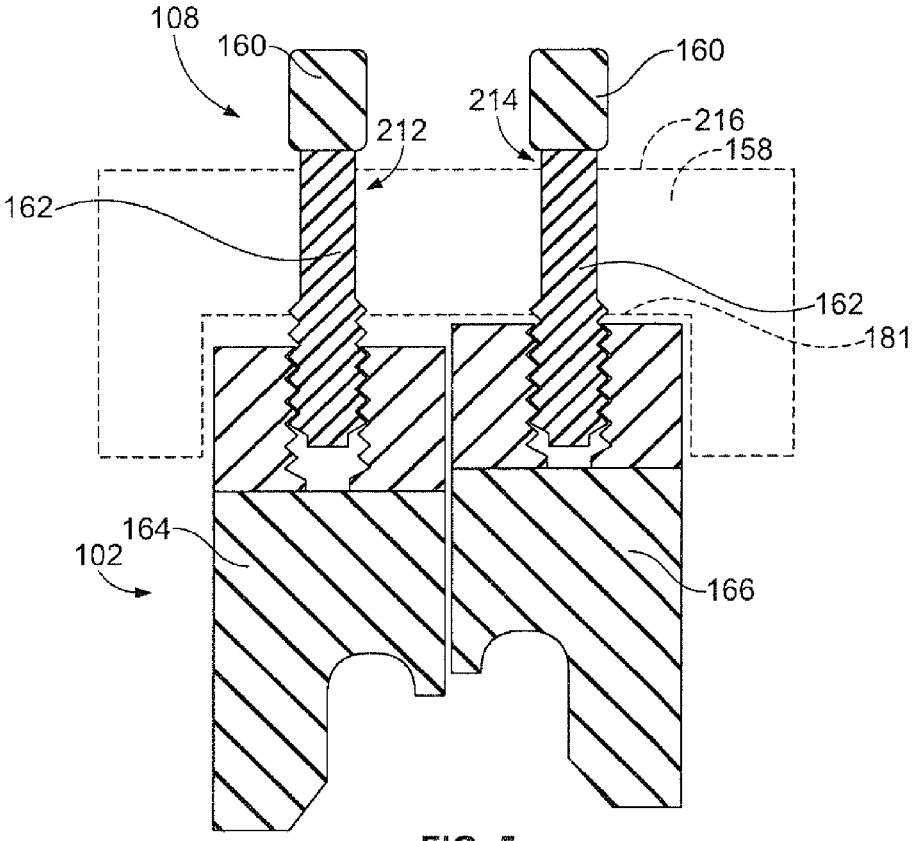
FIG. 5 is a cross-sectional front view of the adjustment mechanism and the punch according to an alternative embodiment.

FIG. 5 is a cross-sectional front view of the adjustment mechanism 108 and the punch 102 according to an alternative embodiment. The adjustment mechanism 108 includes a first adjustment mechanism 212 and a second adjustment mechanism 214. The first adjustment mechanism 212 is configured to adjust the position of the left punch member 164, and the second adjustment mechanism 214 is configured to adjust the position of the right punch member 166. The adjustment mechanisms 212, 214 differ from the adjustment mechanisms 108A, 108B shown in FIGS. 3 and 4 because the adjustment mechanisms 212, 214 do not include worm drives. For example, the drive bolt 162 couples directly to the knob 160, and rotation of the knob 160 rotates the drive bolt 162 directly. The drive bolt 162 extends fully through the punch holder 158, shown in phantom in FIG. 5, between the ceiling 181 and a top wall 216 of the punch holder 158. The knob 160 is disposed above the top wall 216. In the illustrated embodiment, the drive bolt axis and the knob axis are co-axial. In other embodiments, adjustment mechanisms may include spur gears or other types of gears, other than worm drives, disposed between the knob and the drive bolt.

Figure 6:
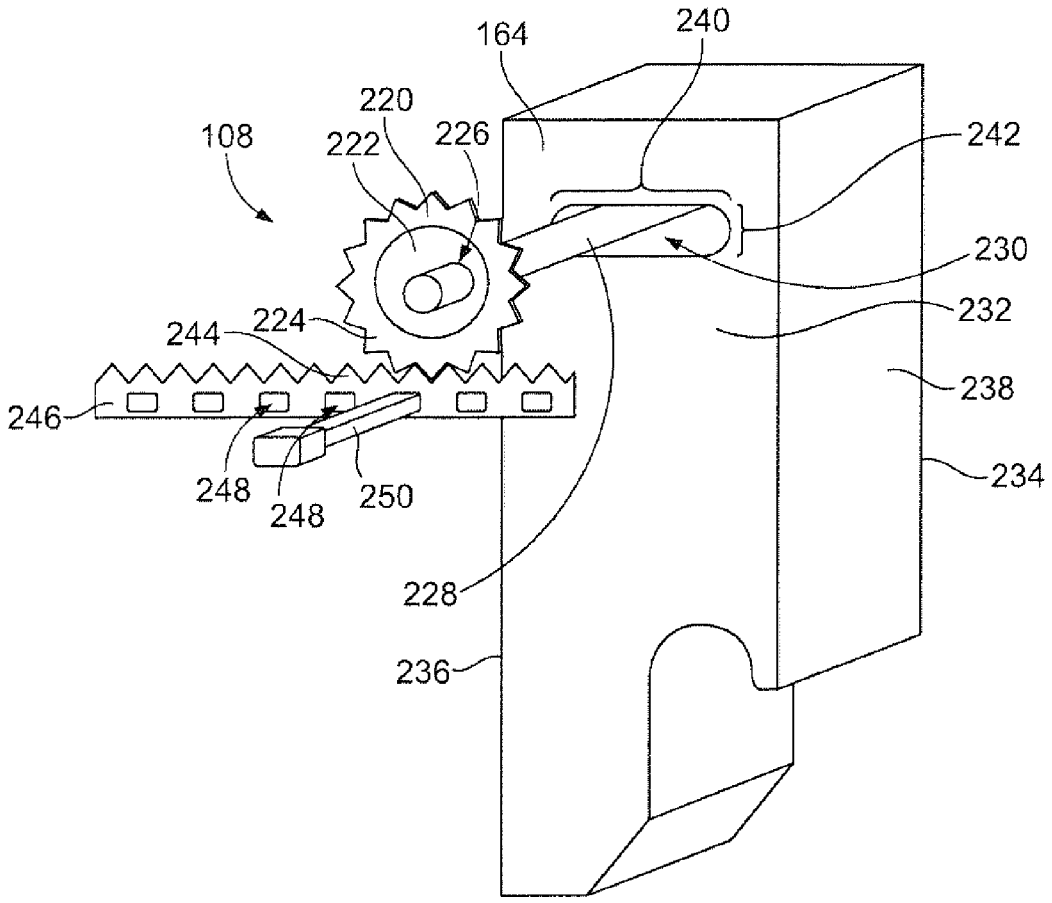
FIG. 6 is a perspective view of the adjustment mechanism and a punch member of the punch according to an alternative embodiment.

FIG. 6 is a perspective view of the adjustment mechanism 108 and a punch member of the punch 102 (shown in FIG. 1) according to an alternative embodiment of the adjustment mechanism 108. For example, the punch member 164 may be the left punch member 164 shown in FIG. 2. In the illustrated embodiment, the actuator is a gear 220, and the transfer member is an eccentric bushing 222. The gear 220 has a rounded shape, which optionally may be circular, and has teeth 224 along an outer perimeter. The eccentric bushing 222 defines a hole 226 that is not centered relative to an outer perimeter of the bushing 222. For example, the a center point of the hole 226 is not located at a center point of the bushing 222. The gear 220 is rotatably coupled to bushing 222. For example, the gear 220 is coupled to a front side, a rear side, or an outer surface of the bushing 222, such that rotation of the gear 220 causes the bushing 222 to rotate along the same axis of rotation.

The bushing 222 is operably coupled to the punch member 164 via a rod 228 that extends through the hole 226 of the bushing 222 and into a slot 230 defined in a side wall of the punch member 164. In the illustrated embodiment, the slot 230 extends through at least a front side wall 232 of the punch member 164 towards, and optionally through, an opposite back side wall 234. Alternatively, the slot 230 may extend through a left side wall 236 and/or a right side wall 238 of the punch member 164. As the bushing 222 rotates, the hole 226 transfers the rotational movement into translational movement of the rod 228. The movement of the rod 228 moves the punch member 164 that is coupled thereto, which moves the punch member 164 from a first operative position to a second operative position relative to the punch zone 107 (shown in FIG. 1). For example, the movement of the hole 226 of the bushing 222 causes the rod 228 to translate in an arcing motion that includes both vertical and horizontal movement. The vertical movement of the rod 228 advances the punch member 164 vertically, upwards and/or downwards, relative to the punch zone 107.

In an embodiment, the slot 230 has a horizontal width 240 that is greater than a diameter of the rod 228. The wide slot 230 accommodates the horizontal movement (or translation) of the rod 228, caused by the horizontal movement of the hole 226 of the bushing 222, without moving the punch member 164 horizontally. For example, due to strict design specifications and tolerances, movement of the punch member 164 horizontally may be undesired, as such movement may detrimentally affect the rolling or forming operation. Thus, the wide slot 230 allows movement of the punch member 164 to be restricted to vertical movement only. The slot 230 may have a vertical height 242 that is equal to or slightly greater than the diameter of the rod 228, such that at least most of the vertical movement of the rod 228 is transferred to the punch member 164 to advance the punch member 164 vertically relative to the punch zone 107 (shown in FIG. 1).

In an embodiment, the gear 220 is rotated via a rack bar 246, which extends linearly. For example, the teeth 224 of the gear 220 intermesh with teeth 244 of the rack bar 246. Linear movement of the rack bar 246 causes the gear 220 to rotate. Optionally, the rack bar 246 may include multiple notches 248 spaced apart along the length of the rack bar 246. The notches 248 are configured to receive a pin 250. The pin 250 may be spring-loaded. The pin 250 may be mounted on a supporting structure, such as the holder 158 (shown in FIG. 2), such that engagement of the pin 250 with one of the notches 248 locks the rack bar 246 in place relative to the supporting structure. Locking the rack bar 246 in place also locks the gear 220 in place since the teeth 224 of the gear 220 intermesh with the teeth 244 of the rack bar 246. Furthermore, locking the gear 220 in place fixes the punch member 164 in position relative to the punch zone 107 (shown in FIG. 1). Thus, the vertical position of the punch member 164 may be adjusted by un-locking the pin 250 from one of the notches 248, moving the rack bar 246 linearly to rotate the gear 220, which translates the rod 228 and the punch member 164, until the punch member 164 reaches a desired position relative to the punch zone 107, and then locking the pin 250 in another notch 248 to fix the punch member 164 (and the adjustment mechanism 108) in place.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A press device for forming a work piece comprising:

a punch having a top wall, a bottom wall, and a side wall extending between the top and bottom walls, the punch configured to move along a punch stroke towards and away from a punch zone below the bottom wall of the punch, the bottom wall configured to engage a work piece located in the punch zone during the punch stroke to form the work piece, the side wall defining a slot therein; and an adjustment mechanism coupled to the punch, the adjustment mechanism including an actuator and a transfer member, the actuator rotationally coupled to the transfer member, the transfer member operably coupled to the punch, wherein the actuator is configured to rotate and the transfer member converts the rotational movement of the actuator into translational movement that advances the punch linearly from a first operative position relative to the punch zone to a second operative position relative to the punch zone, wherein the actuator is a gear and the transfer member is an eccentric bushing, the eccentric bushing defining a hole that is off-centered relative to an outer perimeter of the eccentric bushing, the adjustment mechanism further including a rod extending between the eccentric bushing and the punch, the rod received in the hole in the eccentric bushing and the slot in the side wall of the punch to couple the eccentric bushing to the punch, wherein rotation of the gear rotates the eccentric bushing, the hole of the eccentric bushing transferring the rotational movement into translational movement of the rod and the punch coupled thereto, moving the punch from the first operative position to the second operative position.

2. The press device of claim 1, wherein as the eccentric bushing rotates, the movement of the hole causes the rod to translate both vertically and horizontally, the slot that extends through the side wall of the punch having a horizontal width that is greater than a diameter of the rod to accommodate the horizontal translation of the rod without moving the punch horizontally, the slot having a vertical height that is at least one of equal to or slightly greater than a diameter of the rod such that the vertical translation of the rod advances the punch vertically from the first operative position to the second operative position.

3. The press device of claim 1, wherein the adjustment mechanism further includes a rack bar that has teeth along a length of the rack bar, the rack bar defining notches spaced apart along the length of the rack bar, the gear having teeth that intermesh with the teeth of the rack bar such that linear movement of the rack bar rotates the gear, the notches of the rack bar configured to receive a pin to lock the rack bar and the gear coupled thereto in place, fixing the punch in the second operative position.

4. The press device of claim 1, wherein the punch defines a roll profile in the bottom wall, the roll profile extending towards the top wall, the roll profile of the punch engaging the work piece in the punch zone as the punch moves along the punch stroke towards the punch zone to bend the work piece into a pre-defined shape.

5. The press device of claim 1, wherein the punch zone is located on a base below the punch, the base configured to receive multiple consecutive work pieces in the punch zone.

6. The press device of claim 1, wherein the punch includes a left punch member and a right punch member that is adjacent to the left punch member, the adjustment mechanism is a left adjustment mechanism coupled to the left punch member and configured to move the left punch member relative to the punch zone, the press device further including a right adjustment mechanism coupled to the right punch member and configured to move the right punch member relative to the punch zone independently of the left punch member.

7. The press device of claim 1, wherein the punch is defined by a left punch member and a right punch member that are adjacent to each other and each define respective portions of the top wall and the bottom wall of the punch, the left and right punch members each defining a portion of a roll profile of the punch that is configured to curl the work piece around an electrical wire during the punch stroke, the left punch member defining a left arch of the roll profile, the right punch member defining a right arch of the roll profile, the left and right arches each having a concave shape relative to the bottom wall of the punch.

8. A press device for forming a work piece comprising:

a punch having a top wall and a bottom wall, the punch configured to move along a punch stroke towards and away from a punch zone below the bottom wall of the punch, the bottom wall configured to engage a work piece located in the punch zone during the punch stroke to form the work piece, the top wall defining an opening therein; and an adjustment mechanism coupled to the punch, the adjustment mechanism including a knob and a threaded drive bolt, the drive bolt rotationally coupled to the knob indirectly via a worm drive such that rotation of the knob causes the drive bolt to rotate, the worm drive including a worm bolt that includes threads and a worm wheel that includes teeth, the worm bolt coupled to and rotationally fixed to the knob, the worm wheel coupled to and rotationally fixed to the drive bolt, the threads of the worm bolt intermeshing with the teeth of the worm wheel, the drive bolt threadably coupled to the punch through the opening in the top wall of the punch, wherein, rotation of the knob and the worm bolt rotates the worm wheel and the drive bolt, the rotation of the drive bolt moving the punch linearly from a first operative position relative to the punch zone to a second operative position relative to the punch zone.

9. The press device of claim 8, further comprising a punch holder, the adjustment mechanism held by the punch holder, the drive bolt coupling the punch to the punch holder, the drive bolt configured to rotate relative to the punch holder without translating relative to the punch holder, rotation of the drive bolt causing the punch to translate relative to the punch holder.

10. The press device of claim 8, further comprising a movable ram disposed above the top wall of the punch, the ram engaging a top surface of the worm wheel above the top wall of the punch to propel the punch along the punch stroke towards the punch zone.

11. The press device of claim 8, wherein the drive bolt and the worm wheel rotate along a drive bolt axis and the knob and the worm bolt rotate along a knob axis, the drive bolt axis being oblique to the knob axis.

12. The press device of claim 8, wherein the knob includes markings that quantify an amount of rotation of the knob.

13. The press device of claim 8, wherein the punch is defined by a left punch member and a right punch member that are adjacent to each other and each define respective portions of the top wall and the bottom wall of the punch, the left and right punch members each defining a portion of a roll profile of the punch that is configured to curl the work piece during the punch stroke, the left punch member defining a left arch of the roll profile, the right punch member defining a right arch of the roll profile, the left and right arches each having a concave shape relative to the bottom wall of the punch.

14. The press device of claim 13, wherein the adjustment mechanism is a left adjustment mechanism coupled to the left punch member and configured to move the left punch member relative to the punch zone independently of the right punch member to adjust a position of the left arch of the roll profile relative to a position of the right arch of the roll profile.

15. The press device of claim 8, wherein the drive bolt rotates along a drive bolt axis, rotation of the drive bolt causing the punch to move linearly from the first operative position to the second operative position in a direction parallel to the drive bolt axis.

16. A press device for forming a work piece comprising:

a punch defined by a left punch member and a right punch member that are adjacent to each other, the left and right punch members each having a top wall and a bottom wall, the left and right punch members configured to move together along a punch stroke towards and away from a punch zone below the bottom walls of the left and right punch members, the left and right punch members each defining a portion of a roll profile of the punch that is configured to engage and form a work piece located in the punch zone during the punch stroke, the left punch member defining a left arch of the roll profile along the bottom wall thereof, the right punch member defining a right arch of the roll profile along the bottom wall thereof, the left and right arches each having a concave shape relative to the respective bottom walls of the left and right punch members, the left and right arches configured to engage respective left and right wings of the work piece during the punch stroke to bend the left and right wings, the left and right punch members each defining an opening in the respective top wall thereof; and left and right adjustment mechanisms coupled to the left and right punch members, respectively, the left and right adjustment mechanisms each including a knob and a threaded drive bolt, the drive bolt rotationally coupled to the knob such that rotation of the knob causes the drive bolt to rotate, the drive bolt threadably coupled to the respective punch member through the opening in the top wall of the punch member, wherein, rotation of the drive bolt via the knob moves the respective punch member linearly from a first operative position relative to the punch zone to a second operative position relative to the punch zone.

17. The press device of claim 16, wherein the top wall of each of the left and right punch members is defined by a nut that is fixed to a body of the respective punch member, the nut having grooves that engage threads of the respective drive bolt.

18. The press device of claim 16, wherein rotation of the left adjustment mechanism moves the left punch member independently of the right punch member and rotation of the right adjustment mechanism moves the right punch member independently of the left punch member.

19. The press device of claim 16, wherein the drive bolt of each of the left adjustment mechanism and the right adjustment mechanism is indirectly rotationally coupled to the respective knob via a worm drive, the worm drive including a worm bolt that includes threads and a worm wheel that includes teeth, the worm bolt coupled to and rotationally fixed to the knob, the worm wheel coupled to and rotationally fixed to the drive bolt, the threads of the worm bolt intermeshing with the teeth of the worm wheel such that rotation of the knob and the worm bolt causes the worm wheel and the drive bolt to rotate.

20. The press device of claim 16, wherein the roll profile of the punch includes a middle region between the left and right aches, the left and right punch members each defining a portion of the middle region, the middle region between the left and right arches extending generally downwards towards the bottom walls of the left and right punch members such that the roll profile generally has an "M" shape.

* * * * *